US005334258A

United States Patent [19]

Osano et al.

[11] Patent Number: 5,334,258

[45] Date of Patent: Aug. 2, 1994

[54] WASHING METHOD

[75] Inventors: Nagato Osano, Kawasaki; Yukihiro Imai, Utsunomiya; Akihito Hosaka, Ayase; Ikuo Nakajima, Tokyo; Toshiji Nishiguchi, Kawasaki; Akira Horie, Toride, all of Japan

[73] Assignee: Canon Kabushiki Kaisha, Japan

[21] Appl. No.: 913,047

[22] Filed: Jul. 14, 1992

[30] Foreign Application Priority Data

Jul. 16, 1991 [JP] Japan ..... 3-175513
Sep. 18, 1991 [JP] Japan ..... 3-237936

[51] Int. Cl.[5] ..... B08B 3/08

[52] U.S. Cl. ..... 134/42; 134/26; 134/40

[58] Field of Search ..... 134/26, 40, 42

[56] References Cited

U.S. PATENT DOCUMENTS

| | | | |
|---|---|---|---|
| 4,314,856 | 2/1982 | Steimel | 134/40 X |
| 4,319,930 | 3/1982 | Yano | 134/26 |
| 4,599,187 | 7/1986 | Hey | 134/26 |
| 4,907,613 | 3/1990 | Litzaw | 134/158 |
| 4,962,879 | 10/1990 | Goesele et al. | 228/116 |
| 5,169,455 | 12/1992 | Kessler | 134/42 X |

FOREIGN PATENT DOCUMENTS

| | | | |
|---|---|---|---|
| 0310922 | 4/1989 | European Pat. Off. .. | |
| 523299 | 4/1931 | Fed. Rep. of Germany . | |
| 2852588 | 6/1979 | Fed. Rep. of Germany . | |
| 0028684 | 3/1981 | Japan | 134/26 |
| 403031489 | 2/1991 | Japan | 134/26 |

OTHER PUBLICATIONS

V. Frank, "Chemical Cleaning Technique for Vibratory Bowl Feeder," *IBM Technical Disclosure Bulletin, vol. 25, No. 11B, Apr. 1983, pp. 6267–6268.*

Patent Abstracts of Japan, vol. 13, No. 557 (P-974) (Dec. 12, 1989) & JP-A-01 233 413.

*Primary Examiner*—David B. Springer

*Attorney, Agent, or Firm*—Fitzpatrick, Cella, Harper & Scinto

[57] ABSTRACT

Disclosed is a washing method in which parts and products are washed free of residual smudges without using fleon-family solvents. The method of washing members such as parts or products comprises a first degreasing step for degreasing in nonaqueous liquid the members to be washed after worked, a second degreasing step for degreasing the members being washed in an aqueous liquid which dissolves the nonaqueous liquid, a finish washing step for washing in the aqueous liquid, a rinsing step, and a drying step, wherein the drying step is performed in a plurality of pure water baths, the temperature of a last pure water bath is established to a range of 70° to 85° C., and the washed members are taken out from the pure water bath for drying the surfaces thereof.

Also, the washing method is disclosed in which pure water in a plurality of the pure water baths has temperature gradient in the sequence of washing steps.

Furthermore, the washing method is disclosed in which the speed of taking out the washed members from the last pure water bath is established so as to be in inverse proportion to the surface area of the washed member.

3 Claims, 5 Drawing Sheets

WASHING METHOD

BACKGROUND OF THE INVENTION

1. Field of the Invention

The present invention relates to a washing method for parts or products, particularly, a washing method for optical parts.

2. Related Background Art

According to conventional practice, machine parts and optical parts are washed after processed, for example, through steps as shown in FIG. 7.

The steps of washing will hereinafter be described.

Step a

Pitch adhering to the surface of a member to be washed (not shown) is removed by a nonaqueous solvent.

The member to be washed is dipped into and taken out from a first degreasing liquid 201 to a fourth degreasing liquid 204 by a conveying mechanism (not shown). The four liquids are perchloroethylene, respectively. Each liquid is at a room temperature.

Step b

An aqueous liquid (water system) is substituted for said nonaqueous liquid covering the surface of said member being washed. In other words, said member being washed is dipped into and taken out from a first substituting liquid 205 and a second substituting liquid 206.

The first substituting liquid 205 and the second substituting liquid 206 are aqueous solution containing a surface-active agent. Each liquid is at a room temperature.

Step c

Finish washing is performed.

Said member being washed is dipped into and taken out from a first finish washing liquid to a third finish washing liquid.

The first finish washing liquid 207 is city water (tap water). The second finish washing liquid 208 is an anionic or nonionic surface-active agent. The third finish washing liquid 209 is identical to the washing liquid 208.

Step d

Rinsing is performed.

Said member being washed is dipped into and taken out from a first rinse liquid 210 and a second rinse liquid 211.

Both the first and second rinse liquids are city water.

Step e

Said member being washed is dipped into and taken out from a first substituting liquid 212 and a second substituting liquid 213 for substitution of a nonaqueous solvent (nonaqueous system).

Both the first and second substituting liquids are IPA ( isopropyl alcohol).

Step f

Said IPA adhering to said member being washed is removed by drying.

The member being washed is held for a predetermined period of time in freon vapor 214 which is generated by heating freon liquid by a heater (not shown), and then is taken out therefrom.

In the method of the prior art described above, freon family solvents are essential. With an increasing demand for environmental protection in recent years, washing without using freon has been required, as in various other fields. A major problem in washing without using freon is, for example, so-called residual smudge which arises in a drying step after wet washing.

SUMMARY OF THE INVENTION

An object of the present invention is to provide a method for washing parts or products free of residual smudges without using freon solvents.

A washing method according to the present invention for washing members such as parts or products, comprises a first degreasing step for degreasing in nonaqueous liquid said members to be washed after being degreased, a second degreasing step for degreasing said members being washed in an aqueous liquid dissolving said nonaqueous liquid , a finish washing step for washing in said aqueous liquid, a rinsing step, and a drying step, and is characterized in that said drying step is performed in a plurality of pure water baths, the temperature of a last pure water bath is established to be in a range of 70° to 85° C., and said washed members are taken out from said pure water bath for drying the surfaces thereof.

Also, said washing method is characterized in that pure water in said plurality of pure water baths has temperature gradient in the sequence of washing steps.

Furthermore, said washing method is characterized in that the speed of taking out said washed members from said last pure water bath is established so as to be in inverse proportion to the surface area of said washed member.

When washing works in washing liquid, the action of the washing liquid's surface tension causes the washing liquid to stay in the portion between said product or product component and a projection and between said work and a jig surface, resulting in defective washing defect, a reduction of rinsing effect, and a deterioration of drying performance.

A second object of the present invention is to provide a washing device and a washing method allowing steps of washing, rinsing, and drying, without any washing liquid remaining as one continuous process.

A washing device of the present invention has a portable body for use in washing a member having a hole, and is characterized by comprising holding means provided on said body for holding said member to be washed, and a projection provided on said body to be inserted in noncontact manner into the hole in said member to be washed.

The washing device can comprise a plurality of sets of holding means and a projection.

A washing device of the present invention has a portable body for use in washing a polygonal reflecting mirror having a hole portion in a bottom surface thereof and side surfaces of mirror, and is characterized by comprising holding means provided on said body for holding the bottom surface of said member to be washed in point contact manner at edge portions thereof, and a projection provided on said body to be inserted in noncontact manner into the hole portion in said member to be washed.

The washing device can also comprises a plurality of sets of holding means and a projection.

Furthermore, the washing method of the present invention for wetly washing a member of a polygonal reflecting mirror having a hole portion in a bottom surface thereof and side surfaces of mirror, is characterized in that after holding the bottom surface of said member to be washed at edge portions thereof by the holding means of the washing device of the present invention, and inserting the projection of said washing jig in noncontact manner into the hole portion in said member to be washed, said member is washed in hydrophilic liquid, thereafter the mirror surfaces of said member being washed are washed in ultra-pure water, and said member washed in the ultra-pure water is dried together with said washing device.

DESCRIPTION OF THE PREFERRED EMBODIMENTS

Embodiments of the present invention will hereinafter be described with reference to the drawings.

Figure 1:
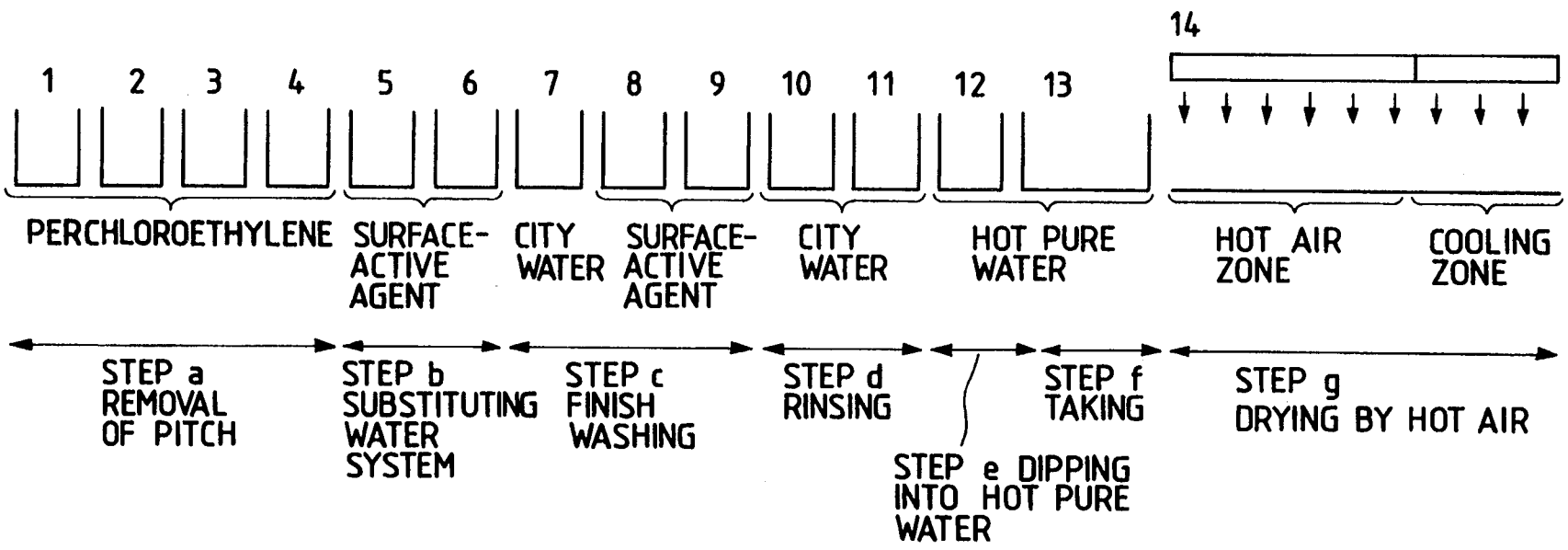
FIG. 1 is an explanatory drawing schematically showing an washing method according to the present invention.

FIG. 1 is an explanatory drawing schematically showing an embodiment of washing equipment of the present invention.

The present embodiment comprises four degreasing baths 1, 2, 3, and 4, four washing members in nonaqueous liquid, two washing baths 5 and 6 for washing out the nonaqueous liquid, a rinsing bath 7 for washing members in city water, washing baths 8 and 9 to finish washing members, rinsing baths 10 and 11 for washing members in pure water, hot pure water baths 12 and 13 for dipping members into heated ultra-pure water, and a drying chamber for drying washed members, i.e. a hot air zone 14.

Next, a washing method according to the present embodiment will be described.

First, members to be washed (for example, optical glass finished by a known polishing process) are dipped into the degreasing baths 1, 2, 3, and 4 filled with an organic solvent such as perchloroethylene for removing adhering pitch, oil and the like from the members being washed.

The members being washed which have been subjected to the step a are dipped into the washing baths 5 and 6 filled with a surface-active agent to finish the step b.

The members being washed which have been subjected to the steps a and b are dipped into the washing bath 7 filled with city water, and furthermore are dipped into the washing baths 8 and 9 filled with a surface-active agent to finish the finish washing step, i.e. the step c. Then, the members being washed are dipped into the rinsing baths 9 and 10 filled with pure water to finish the rinsing step.

The members being washed which have been subjected to the steps a to d are moved to the step e, i.e. a dipping into hot pure water step. The members being washed are dipped into the ultra-pure bath 12 filled with ultra-pure water (resistivity is about 10 MΩ.cm or more) which has been purified by ultra-pure water producing apparatus, described later, and is heated to about 40° C. by a heater (not shown) to finish the dipping into hot pure water step. Then, the members being washed are moved to a taking out step, i.e. the step f. The taking out bath 13 is filled with ultra-pure water having equivalent water quality to the ultra-pure water contained in the ultra-pure water tank 12, except in being heated to about 70° C. to 85° C. by a heater (not shown). The washed members are taken out from the taking out bath at a taking out speed of 3 to 10 mm/sec. The washed members taken out are moved to the drying step g for drying by hot air heated to about 60° C. by a heater (not shown) and cleaned by a HEPA filter (dust collecting filter) (not shown). This step of drying by hot air shortens drying time, but may be deleted.

The relationship between a speed of taking out from the taking out bath 13 and the surface area of a washed member has been obtained as shown in Table 1.

Cleanliness has been measured for glass lenses which have been subjected to the above steps for washing, as shown in Table 1.

Lens materials used are BK7, SF6, and LakS, and measurement has been made visually by lamplight after a polishing process.

TABLE 1

| surface area ($mm^2$) | taking-out speed (mm/sec) | | | | | |
|---|---|---|---|---|---|---|
| | 3 | 4 | 5 | 6 | 7 | 8 |
| 20 | o | o | o | o | o | o |
| 50 | o | o | o | o | o | o |
| 100 | o | o | o | o | o | x |
| 500 | o | o | o | o | x | x |
| 1000 | o | o | o | x | x | x |
| 3000 | o | o | x | x | x | x |
| 5000 | o | o | x | x | x | x |

o: good cleanliness
x: occurrence of washing smudge

COMPARATIVE EXAMPLE

In a comparative example 1 identical with the embodiment except that ultra-pure water in the ultra-pure water bath 12 is at a room temperature, washing smudges have occurred in washed members in all cases.

COMPARATIVE EXAMPLE 2

In a comparative example 2 identical with the embodiment except that the ultra-pure water bath 12 and the taking out bath 13 are filled with ordinary water in place of ultra-pure water, washing smudges have occurred in washed members in all cases.

As described above, according to the present embodiment, a plurality of pure water baths are provided in a drying step for parts or products, the temperature of a last pure water bath is set to a range of 70° to 85° C., and said washed members are taken out from said pure water bath for drying the surfaces thereof, thereby implementing washing without residual smudges.

Next, an embodiment of a washing device of the present invention's second object will be described with reference to the drawings.

Figure 2:
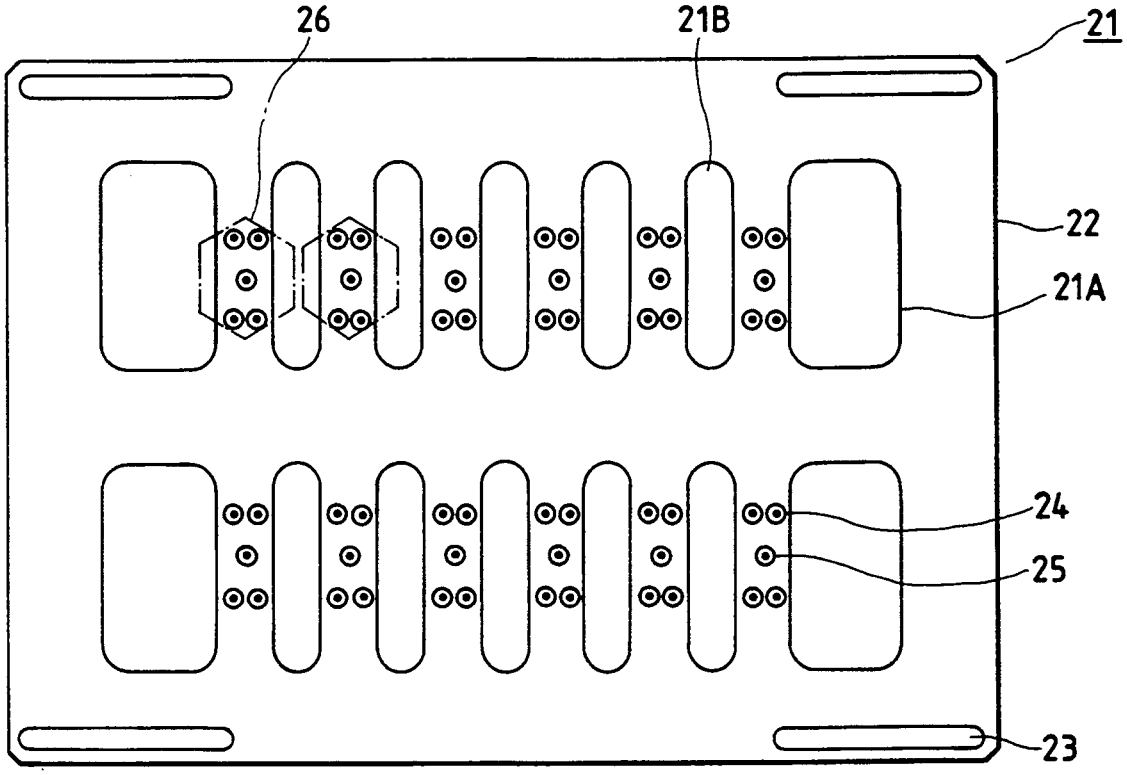
FIG. 2 is a plan view showing an embodiment of a washing device (washing jig).
Figure 3:
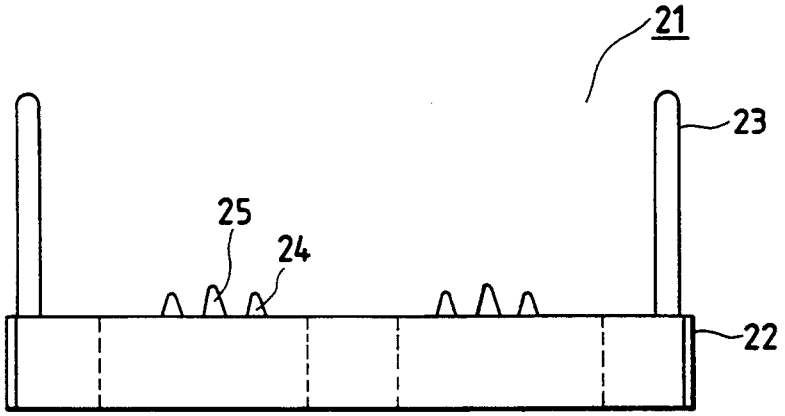
FIG. 3 is a front view of the washing jig shown in FIG. 1.
Figure 4:
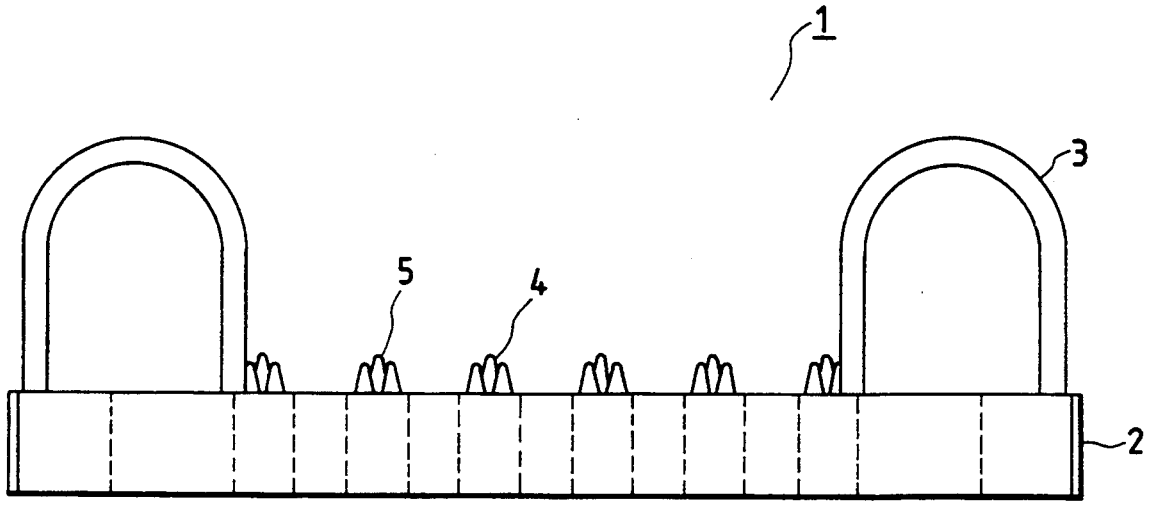
FIG. 4 is a side view of the washing jig shown in FIG. 1.
Figure 5:
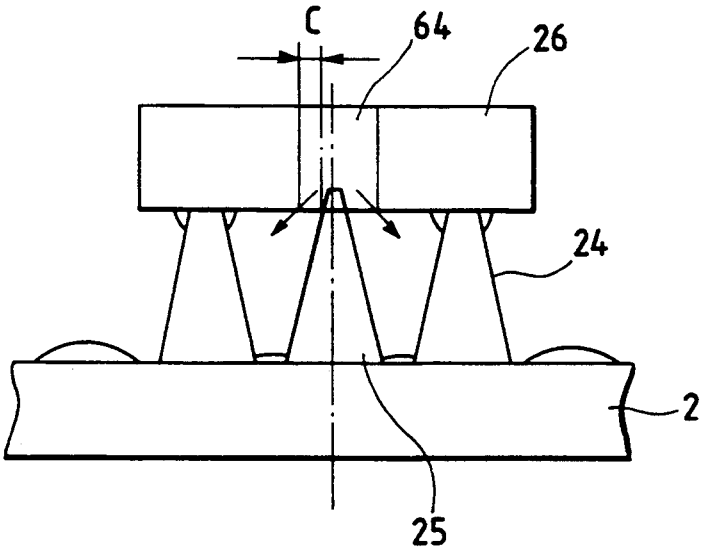
FIG. 5 is an explanatory drawing showing the relationship between the washing jig of the present embodiment and a work.

FIG. 2 is a plan view showing an embodiment of a washing device of the present invention. FIG. 3 is a front view of the washing device shown in FIG. 2. FIG. 4 is a side view of the washing device shown in FIG. 2. FIG. 5 is an explanatory drawing showing the relationship between the washing device of the present invention and a work.

A pallet 21 representative of the washing device (jig) of the present embodiment is provided with a plurality of arms 23, a plurality of holding pins 24, and a plurality of insert pins 25, on a jig base plate 22 as a body having a plurality of openings 21A and 21B.

A plurality of openings 21A and 21B are provided so as to permit ultrasonic waves to pass therethrough when the pallet 21 is put in an ultrasonic washing bath (not shown), and the number, size, shape and the like thereof are determined according to conditions of the device to be used and the like. The arms 23 are hooked to be lifted by conveying equipment (not shown) when the pallet 21 is conveyed. The holding pins 24 are representative of holding means for holding the bottom surface of a work 26 in point contact manner at edge portions thereof, thereby preventing the work 26 from moving during ultrasonic washing. As shown in FIG. 3, four holding pins per one work 26 are provided in positions corresponding to bottom surface edge portions of the work 26. The insert pin 25 is a projection to inserted in noncontact manner into a hole portion in the work 26 for liquid drainage, described later, and as shown in FIGS. 1 to 3, the insert pin 25 is formed so as to be slightly longer than the holding pins 24, and one insert pin 25 per work 26 is provided in a position corresponding to the axis of rotation at the center of the work 26. The present embodiment has twelve (12) sets consisting of four holding pins 24 and one insert pin 25 for washing twelve (12) works at a same time.

Next, how to use the washing device of the present embodiment will be described.

First, as shown in FIG. 5, the work 26 such as a polygonal reflecting mirror having a hole portion 64 is put on the holding pins 24 and the insert pin 25. The axis of the hole portion 64 in the work 26 is approximately matched with the axis of the insert pin 25 to have a predetermined clearance c between the hole portion 61 and the insert pin 25. In this state, a washing step, a rinsing step, and a drying step are performed by washing apparatus shown in FIG. 6.

Figure 6:
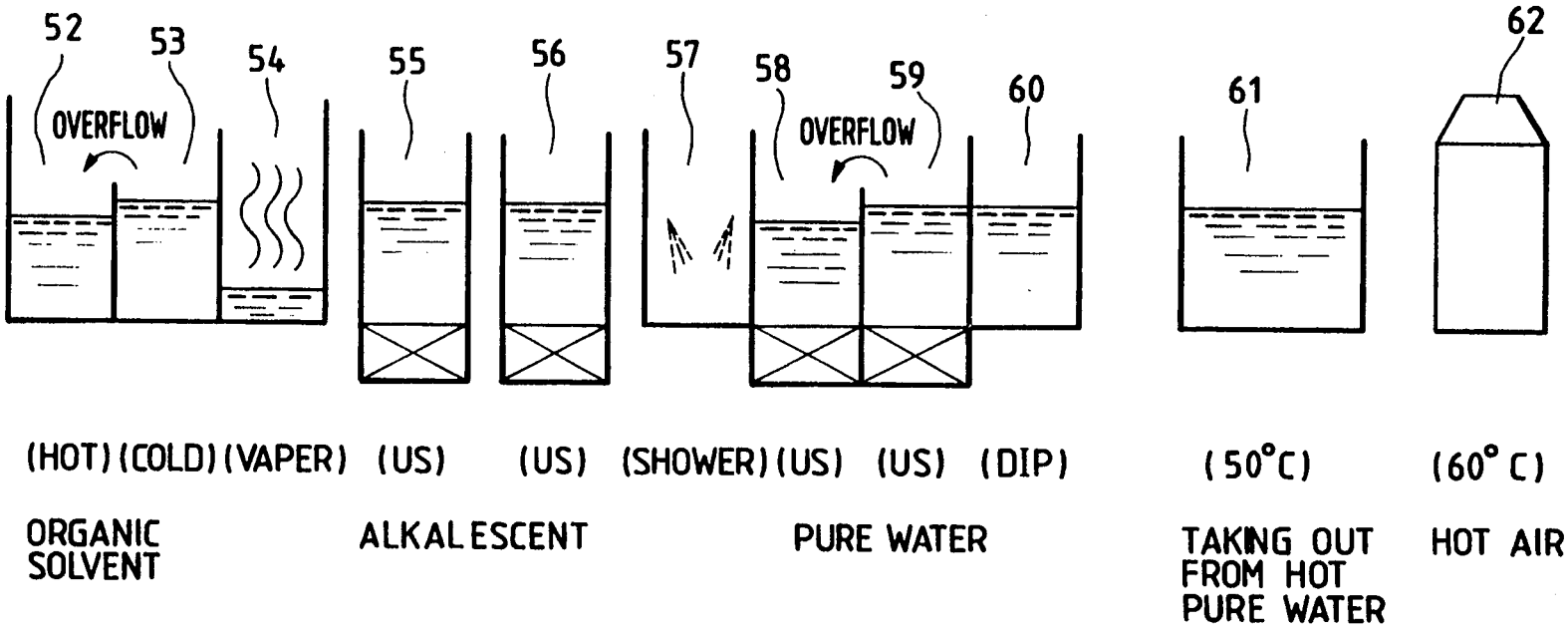
FIG. 6 is an explanatory drawing schematically showing washing equipment to be used in the present embodiment.
Figure 7:
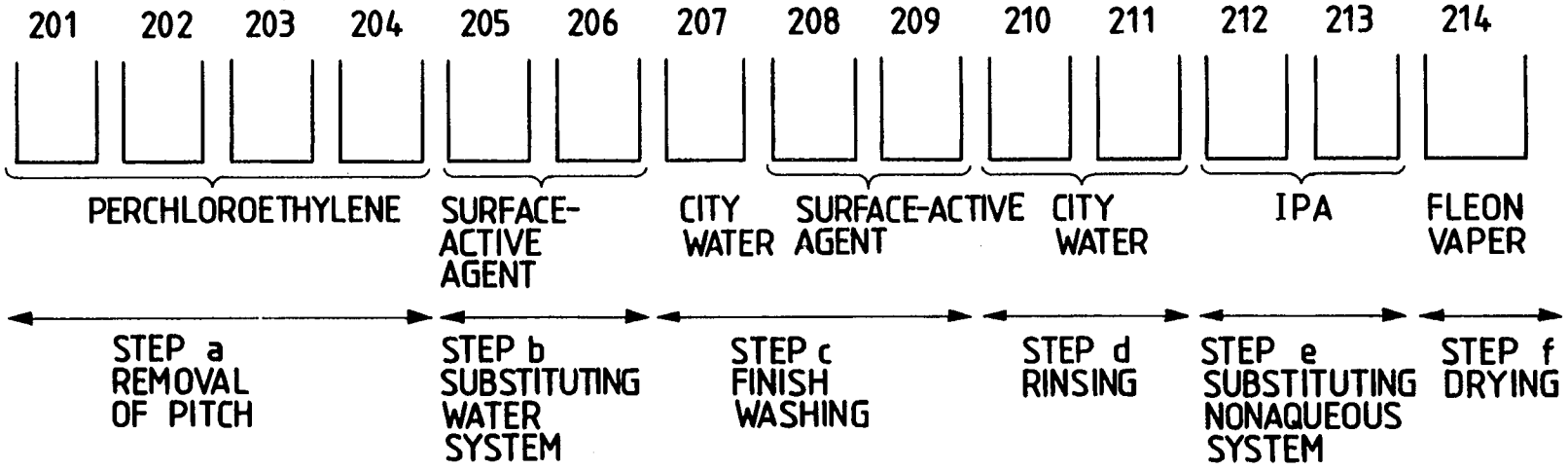
FIG. 7 PRIOR ART
FIG. 7 is an explanatory drawing schematically showing an washing method according to an example of the prior art.

FIG. 6 is an explanatory drawing schematically showing washing equipment to be used in the present embodiment. Works 26 (not shown in FIG. 6) mounted on the pallet 1 shown in FIGS. 2 to 5 are dipped into a first degreasing bath 52 filled with an organic solvent such as 1,1,1-trichloroethane, etc. as nonaqueous liquid heated to about 40° C. to 50° C. by a heater (not shown) to finish a first degreasing step. An organic solvent used in the first degreasing step has been stored by overflowing (OF) the organic solvent used in a next step, i.e., a second degreasing step. Next, the works 26 are moved to the second degreasing step in a second degreasing bath 53 filled with an organic solvent. An organic solvent used in the second degreasing step has been stored by dew formation of vaporized organic solvent (organic solvent vapor) used in a next step, i.e., a third degreasing step. Next, the works 26 are moved the third degreasing step in the aforementioned vaporized organic solvent (organic solvent vapor) in a third degreasing bath 54.

The works 26 which have been subjected to the first to third degreasing steps are dipped into a first ultrasonic washing bath 55 filled with alkalescent surface-active agent as hydrophilic liquid to finish a first washing step, and also to finish a second washing step in a similar second ultrasonic washing bath 56.

The works 26 which have been subjected to the first and second washing steps are moved to a shower bath 57 and are showered therein with pure water (city water may be used) to finish a first rinsing step. Next, the works 26 are dipped into a third ultrasonic washing bath 58 filled with pure water to finish a second rinsing step. Pure water used in the second rinsing step has been stored by overflowing (OF) the pure water used in a next step, i.e., a third rinsing step. Next, the works 26 are dipped into a fourth ultrasonic washing bath 59 filled with pure water purified to an ordinary purity (resistivity is about 1 MΩ.cm), called primary pure water to be described later to finish the third rinsing step. Furthermore, the works 26 are dipped into a pure water bath 60 filled with pure water purified to a similar purity to the third rinsing step to finish a fourth rinsing step.

The works 26 which have been subjected to the first to fourth rinsing steps are moved to a prestep of a drying step to be described later. The works 26 are dipped into an ultra-pure water bath 61 filled with ultra-pure water (resistivity is about 10 MΩ.cm) heated to about 50° C. by a heater (not shown) to finish the prestep of the drying step. The works 26 are taken out from the ultra-pure water, and are exposed to hot air heated to about 60° C. by a heater (not shown) and cleaned by a HEPA filter 62 to finish the drying step. Then, the works 26 are moved to a reflecting film coating step for coating mirror surfaces (side surfaces) thereof with oxide film.

According to the present embodiment, when the aforementioned washing, rinsing and drying steps are performed and metallic bodies are conveyed between steps, the works 26 can be moved together with the washing jig so that the works 26 may not contact each other, thereby preventing an impact on mirror surfaces of the works 26 and any other similar problems.

Conventional ultrasonic washing baths which generate ultrasonic waves of around 28 kHz and are widely used for washing glass and the like, are not suited for use with the first to fourth ultrasonic washing baths 55, 56, 58, and 59, because an erosion will occur on the surface of the work 26 of aluminum or the like. To suppress such erosion, it is preferable to use an ultrasonic washing bath generating ultrasonic waves of 100 kHz or more. However, an ultrasonic washing bath generating ultrasonic waves of over 800 kHz are not preferable because of difficult procurement and weaker cavitation. Consequently, it is preferable to use an ultrasonic washing bath generating ultrasonic waves of around 100 to 800 kHz. Also, the present embodiment uses the ultrasonic washing bath in both washing and rinsing steps , but it is possible to use the ultrasonic washing bath in either washing or rinsing step. Furthermore, it is preferable to move the works 26 up and down in each of the ultrasonic washing baths 55, 56, 58, and 59, because the works 26 can be struck uniformly by ultrasonic waves so that washing effect is improved and surface erosion is prevented more effectively.

In the aforementioned drying step, the washing liquid does not stay in the hole portion 64 in the work 26 but drops by own weight thereof along the insert pin 25.

This is called liquid drainage. Also, since the holding pins 24 keep the bottom portion of the work 26 sufficiently apart from the top surface of the jig base plate 22, the work's bottom portion is also washed sufficiently.

The aforementioned clearance c varies depending on the material of the work 26, the size and shape of the hole portion 64, the composition of washing liquid, etc. For example, for the work 26 of aluminum having a circular hole portion 64 of 4 to 6 mm in diameter, it is preferable that the clearance c is 1 to 3 mm when washing liquid is water.

The material of the holding pin 24 and the insert pin 25 is preferably high in wettability with washing liquid for better liquid drainage.

As described above, according to the present embodiment, an insert pin is inserted into a hole portion in a work so that a predetermined clearance is formed therebetween, thereby providing good liquid drainage from the work and performing the steps of washing, rinsing, and drying as one continuous process without the washing liquid's staying. Consequently, the yield of works improves, and a quality improvement and a cost reduction are attained.

Also, when executing the washing, rinsing and drying steps and carrying metallic bodies between steps, works can be conveyed together with a washing device so that the works may not contact each other, thereby preventing an impact on mirror surfaces of the works and any other similar problems.

What is claimed is:

1. A method for washing an article having optical function, said method comprising the steps of:

degreasing said article, in a degreasing bath containing an organic solvent;

washing said article in a washing bath containing a surface-active agent;

washing said article with a washing liquid being heated to about 70° to 80° C., removing said article from the washing liquid at a speed of 3 to 8 mm/sec. after a specified time in the washing liquid; and drying said article.

2. A method according to claim 1, wherein said article is an optical element of glass, and said taking-out speed is specified for 20 to 5,000 $mm^2$ of a surface area of said article.

3. A method according to claim 1, wherein the water in said washing liquid has a resistivity of more than 10 MΩ.cm.

* * * * *

UNITED STATES PATENT AND TRADEMARK OFFICE

CERTIFICATE OF CORRECTION

PATENT NO. : 5,334,258

DATED : August 2, 1994

INVENTOR(S) : NAGATO OSANO, ET AL.

It is certified that error appears in the above-identified patent and that said Letters Patent is hereby corrected as shown below:

ON TITLE PAGE

In [56] References Cited, under FOREIGN PATENT DOCUMENTS:
"403031489 2/1991 Japan" should read
--3-31489 2/1991 Japan--.

In [57] ABSTRACT, Line 3, "fleon-family" should read
--freon-family--.

IN THE DRAWINGS

Sheet 5 of 5, "FLEON VAPER" should read --FREON VAPOR--.

COLUMN 1

Line 33, "solution" should read --solutions--.

COLUMN 2

Line 39, "work" should read --product or product component--
and "washing" should read --washing,--.
Line 40, "defect," should be deleted.
Line 65, "comprises" should read --comprise--.

COLUMN 3

Line 16, "an" should read --a--.
Line 31, "an" should read --a--.
Line 42, "4, four" should read --4 for--.

UNITED STATES PATENT AND TRADEMARK OFFICE

CERTIFICATE OF CORRECTION

PATENT NO. : 5,334,258

DATED : August 2, 1994

INVENTOR(S) : NAGATO OSANO, ET AL.

It is certified that error appears in the above-identified patent and that said Letters Patent is hereby corrected as shown below:

COLUMN 5

Line 27, "to" should read --to be--.
Line 65, "moved" should read --moved to--.

COLUMN 6

Line 59, "steps , but" should read --steps, but--.

COLUMN 8

Line 13, "80°C.," should read --80°C.;--.

Signed and Sealed this

Eleventh Day of April, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,334,258

DATED : August 2, 1994

INVENTOR(S) : Nagato Osano, et al.

It is certified that error appears in the above-indentified patent and that said Letters Patent is hereby corrected as shown below:

On title page, item [73] Assignee: "Canon Kabushiki Kaisha, Japan" should read —Canon Kabushiki Kaisha, Tokyo, Japan—.

Signed and Sealed this

Sixth Day of June, 1995

Bruce Lehman

*Attest:*

BRUCE LEHMAN

*Attesting Officer*

*Commissioner of Patents and Trademarks*